United States Patent [19]

Duhnkrack et al.

[11] 4,121,897

[45] Oct. 24, 1978

[54] PROCESS FOR PRINTING ON SOLID MOLDED ARTICLES MADE FROM UREA FORMALDEHYDE RESIN OR MELAMINE FORMALDEHYDE RESIN

[75] Inventors: George Bliss Duhnkrack, Suffern; Joseph M. Madeira, Spring Valley, both of N.Y.

[73] Assignee: Koppers Company, Inc., Pittsburgh, Pa.

[21] Appl. No.: 848,263

[22] Filed: Nov. 3, 1977

[51] Int. Cl.[2] ..... D06P 5/00; D06P 3/00

[52] U.S. Cl. ..... 8/2.5 A; 8/1 E; 8/1 G; 8/2.5 R; 8/4

[58] Field of Search ..... 8/2.5 A, 4, 1 E, 2.5 R

[56] References Cited

U.S. PATENT DOCUMENTS

| | | | |
|---|---|---|---|
| 3,363,557 | 1/1968 | Blake | 8/2.5 A |
| 3,707,346 | 12/1972 | Markert et al. | 8/2.5 A |
| 3,829,286 | 8/1974 | Anzai | 8/39 A |
| 3,860,388 | 1/1975 | Haigh | 8/2.5 |
| 3,877,964 | 4/1975 | Orman | 8/2.5 |
| 4,009,995 | 3/1977 | Dressler | 8/4 |

OTHER PUBLICATIONS

"Reactive Dyes" in *Colour Index*, Third Edition, vol. 3 (1971), The Society of Dyers and Colourists, pp. 3391-3393.

*Primary Examiner*—A. Lionel Clingman

*Attorney, Agent, or Firm*—Herbert J. Zeh, Jr.; Oscar B. Brumback

[57] ABSTRACT

A process is provided for printing designs, patterns, decorations, and the like on solid molded polymeric articles made from urea formaldehyde resin or melamine formaldehyde resin. The designs and the like are printed on porous substrate with a printing ink containing about 10 weight percent to about 40 weight percent of one or more dichlorotriazinyl dyes. The printed porous support is contacted with the solid molded polymeric article in a transfer press at a temperature in the range of about 90° C. to about 250° C. in the presence of steam to transfer the printed design to the solid molded polymeric articles.

12 Claims, No Drawings

PROCESS FOR PRINTING ON SOLID MOLDED ARTICLES MADE FROM UREA FORMALDEHYDE RESIN OR MELAMINE FORMALDEHYDE RESIN

BACKGROUND OF THE INVENTION

The process of this invention relates to printing designs, patterns, decorations, symbols, words, and the like of various colors on solid molded polymeric articles made from urea formaldehyde resin or melamine formaldehyde resin.

Printing color designs including decorations, symbols and words on materials can in most cases be considered as a form of localized dyeing. Printing of natural and synthetic materials like wool, cellulosic polyester blends, nylon, polyacrylonitrile and polyethylene can be accomplished by aqueous dyeing with aqueous dye solutions, dispersions, or pastes or by sublimation dyeing or by pad dyeing. Depending on the material to be printed, many types of dyes have been used in printing. These dyes include vat dyes, leuco esters of vat dyes, azoic colors, acid and direct dyes, acetate dyes, basic and mordant colors, disperse dyes and fiber reactive dyes.

Recently the use of sublimation transfer printing methods have become popular in the art for printing textiles. Generally, these methods involve printing an inert support (e.g., paper) with one or more sublimable dyestuffs usually with a cellulosic or similar binder and placing the printed support against the textile, and applying heat to cause the dyestuffs to vaporize and penetrate the textile. The sublimation transfer printing method has been used for textile materials such as wool, polyamide, polyester, polyacrylonitrile, and cellulose di- or triacetate fabrics. These fabrics are dry printed with vapors of a monoazo or anthraquinone disperse dye having a sublimation temperature less then 200° C.

A recent observation was made in U.S. Pat. No. 3,877,964 (Orman) that general sublimation transfer printing methods are not generally effective for decorating some solid polymeric articles. In this patent it was discovered that in order to print or decorate an acrylic sheet the sheet had to be formed by polymerizing the continuous phase of an emulsion having an aqueous disperse phase and a continuous phase of acrylic monomer to form a water-filled cellular material, then the water had to be removed from at least a part of the surface of the material. This cellular material could be printed or decorated by heating a transfer print with sublimable dyes adjacent said part of the surface to a temperature above the sublimation temperature of the dyes so as to vaporize and transfer the dyes to said surface.

Solid molded polymeric substances made of urea formaldehyde resin or melamine formaldehyde resin are difficult to print or decorate. A recent development in the art of dyeing has been disclosed in U.S. Pat. No. 4,009,995 (Dressler). This development is the dyeing of molded synthetic plastic articles containing urea formaldehyde resin or melamine formaldehyde resin. The articles are treated in an aqueous dye bath containing 0.005 to 5.0 weight percent of a dichlorotriazinyl dye or a premetallized dye at a temperature in the range of 50° to 100° C.

Monochlorotriazinyl and dichlorotriazinyl dyes, which are reactive dyes, have been used to print on cellulosic fibers. In direct printing processes, these reactive dyes are often printed on the cellulosic fibers as a thickened aqueous solution containing urea and sodium carbonate or bicarbonate. The printed cellulosic fabric is dried, and the dye is fixed by steaming or baking.

We have found that sublimation transferring dyeing methods are not generally effective for printing or decorating solid molded polymeric articles made predominantly from urea formaldehyde resin or melamine formaldehyde resin. We have also found that even though the dichlorotriazinyl dyes are useful in dyeing plastic articles from a dye bath dichlorotriazinyl dyes do not sublime or vaporize to an acceptable extent to be used in a sublimation transfer printing process for solid molded polymeric articles made from urea formaldehyde resin or melamine formaldehyde resin.

It is an object of this invention to provide a process to print on solid molded polymeric articles made of urea formaldehyde resin or melamine formaldehyde resin to yield a printed or decorated article with good color fastness.

SUMMARY OF THE INVENTION

In accordance with the process of the present invention, designs, patterns, decorations, symbols, words and the like are printed on solid molded polymeric articles made from urea formaldehyde resin or melamine formaldehyde resin to produce printed articles with a good color fastness. The process of the present invention comprises: first, applying to a porous support a printing ink containing one or more dichlorotriazinyl dyes in an amount in the range of about 10 to about 40 weight percent to print on the porous support designs, including patterns, decorations, symbols, words and the like; second, contacting the printed porous support with the solid molded polymeric article made from urea formaldehyde resin or melamine formaldehyde resin in a transfer press at a temperature in the range of about 90° C. to about 250° C. in the presence of steam to transfer the design from the porous substrate to the molded polymeric article.

The porous supports used in the process of this invention may be any material capable of transferring ink by printing techniques such as silk-screen, letterpress, offset, lithographic or gravure to solid objects. Examples of materials useful as the porous supports are paper of different levels of absorbency and permeability, but also including sheets of non-woven or webs of natural or regenerated cellulose, or woven or non-woven cloth which, if desired, can contain small amounts of synthetic fibers to improve their strength, and also including metal sheets.

The dichlorotriazinyl dyes contained in the printing ink are those dyes which are readily associated with the dichlorotriazinyl group. Although not inclusive of all the dyes useful in the process of this invention, examples of these dyes are the water-soluble azo or anthraquinone dyestuffs. These dyes may be associated with the dichlorotriazinyl group by an amino, oxygen, or sulfur bonds. The amount of dichlorotriazinyl dye or mixtures of dichlorotriazinyl dyes in the ink is in the range of at least 10 weight percent because a high amount of dye is required on the porous support for good color transfer to the solid molded polymeric article. The amount of dye or dyes in the printing ink should not exceed about 50 weight percent for economical processing reasons. Beside the dichlorotriazinyl dye, the printing ink contains those ingredients to allow the dye ink system to dry by the coldset, solvent evaporation, absorption, gelation, precipitation, or oxidative polymerization method. Examples of such ingredients include drying oils, modified rosin, and other additives to impart to the ink such characteristics as gloss, drying speed, water resistance, chemical resistance and rub resistance. The printing ink may be an organic or aqueous based printing ink since the dye need only be dispersible rather than soluble in the printing ink.

The solid molded polymeric articles made of urea formaldehyde resin or melamine formaldehyde resin contain the resin alone or a combination of the resin with a minor amount of fillers. The fillers that may be present with the resin in the synthetic solid molded polymeric article and that are innocuous to the transfer printing process of this invention include cellulose, wood flour, walnut shell flour, chopped cotton, glass fiber, paper pulps, synthetic fibers and asbestos.

DETAILED DESCRIPTION OF THE INVENTION

The process of this invention is applicable to any solid molded synthetic polymeric article made of any amount, even up to 100 weight percent, of urea formaldehyde resin or melamine formalehyde resin. The process of this invention may be employed to print designs hereinafter including decorations, symbols, words and the like on solid molded polymeric articles made only of urea formaldehyde or melamine formaldehyde resin. Also, the process of this invention is aptly suited for printing designs on solid molded polymeric articles that are molded from predominantly urea formaldehyde resin or melamine resin along with a minor amount of filler.

The filler which is typically used is cellulose although any other filler for urea formaldehyde resin or melamine formaldehyde resin known to those skilled in the art may be used. It is preferred to use the process of this invention to dye buttons composed of urea formaldehyde resin along with a minor portion of cellulose filler.

Examples of solid molded polymeric articles that are printed with designs according to the process of this invention are buttons and trays, switch plates for electrical outlets, wiring devices, bottle caps and dishes. The solid molded synthetic polymeric article or button may be made by any process known to those skilled in the art. For example, the pre-form formulation for the molded synthetic plastic article may be a fast cure or slow cure formulation. This formulation may be prewarmed or introduced into the heated multicavity compression-type die or press at ambient temperatures. Typically, within 30–45 seconds after the die or press is closed and polymerization is initiated, the charge becomes rigid. After polymerization has advanced sufficiently, the polymeric article cures and is discharged from the die or press. When the solid molded polymeric article is a button, is is possible to make the buttons without a filler but it is preferred that the buttons are made predominantly of urea formaldehyde resin or melamine formaldehyde resin along with a minor amont of cellulose as a filler. When cellulose is used as a filler, the cellulose is thoroughly impregnated with aqueous urea formaldehyde resin or melamine formaldehyde resin. The amount of urea formaldehyde resin or melamine formaldehyde resin is at least 25 weight percent of the button. The amount of cellulose or any other filler for urea formaldehyde resin or melamine formaldehyde resin known to those skilled in the art is not more than 75 weight percent.

The dichlorotriazinyl dyes that may be used with the process of this invention are preferably those amino-substituted reactive dyes such as water soluble azo or anthraquinone dyes that are readily associated with the dichlorotriazinyl group by reaction with cyanuric chloride. Examples of such water soluble azo and anthracene dyes, but not inclusive of all such dyes, that can be used with the process of this invention are those dyes disclosed in the U.S. Pat. No. 3,125,564 and the following British Pat. Nos.: 826,405; 838,340; 829,042; 838,341; 828,353; 838,342; 838,343; 838,344 and 838,345. Examples of the dichlorotriazinyl-amino-substituted reactive dyes from Color Index third edition, 1971, published by The Society of Dyers and Colorists, Bradford, Yorkshire, BD1 2JB ENgland, that may be used include: C.I. reactive blue 4 (C.I. constitution number 61205); C.I. reactive orange 1 (C.I. constitution number 17907); C.I. reactive red 2; C.I. reactive yellow 86; C.I. reactive brown 10; C.I. reactive blue 1; C.I. reactive orange 4; C.I. reactive red 1 (C.I. constitution number 181158); C.I. reactive red 11; C.I. reactive red 6 (C.I. constitution number 17965); C.I. reactive red 8 (C.I. consitution number 17908); C.I. reactive yellow 22; C.I. reactive yellow 1; C.I. reactive yellow 7; C.I. reactive yellow 4; C.I. reactive yellow 4; C.I. reactive green 7; C.I. reactive brown 23; C.I. reactive blue 109; and C.I. reactive blue 161. These dyes may be obtained from Imperial Chemical Industries Ltd., Manchester M93DA, England, under the "Procion M" trademark. It is within the scope of this invention that any dye that readily associates with the dichlorotriazinyl group may be used. Examples of other dyes that can be associated with the dichlorotriazinyl group and used in the process of this invention include: oxygen-associated and sulfur-associated dyes.

Shade variation in the printing of urea formaldehyde resin or melamine formaldehyde resin containing buttons can be readily obtained by mixing the dichlorotriazinyl type dyes. For instance, 1 weight percent C.I. reactive yellow 86/1 weight percent C.I. reactive red 2 gave an orange-red shade, 1 weight percent C.I. reactive yellow 86/1 weight percent C.I. reactive blue 4 (61205) gave a green shade, 1 weight percent C.I. reactive brown 10/1 weight percent C.I. reactive yellow 86 gave a yellow-brown shade, 1 weight percent C.I. reactive blue 4 (61205)/1 weight percent C.I. reactive brown 10 gave a violet shade, and 1 weight percent C.I. reactive blue 4 (61205)/1 weight percent C.I. reactive red 2 gave a purple shade.

The printing inks useful in the process of this invention to print the porous support are solutions or dispersions of one or more of the dichlorotriazinyl dyes in a liquid medium which can be either water or an organic liquid. The organic liquid should be one that boils at a temperature below 150° C. at atmospheric pressure, or an emulsion of two or more immiscible liquids. The organic liquid should be one that has a boiling point below 150° C. at atmospheric pressure. Examples of such organic liquids include ethanol, isopropanol, methyl ethyl ketone, ethyl acetate and mixtures thereof. The inks may also contain dispersing agents for the dichlorotriazinyl dye, and also a binder that is soluble in the liquid medium and which assists in retaining the dichlorotriazinyl dye on the porous support. The dispersing agents used will be generally those that are soluble in the liquid present in the ink. If the liquid present is water, which is the preferred liquid medium for the printing ink, the dispersing agents used will be water-soluble dispersing agents such as condensates of ethylene oxide with amines, alcohols, or phenols or the sodium salts of alkylnaphthalene sulfonic acids. If the liquid present is an organic liquid, then the dispersing agents will usually be soluble in organic liquids. Examples of such dispersing agents are alkyl celluloses and cellulose esters, such as nitrocellulose, cellulose acetate, ethylcellulose and hydroxyalkyl celluloses. Some of the substances used as dispersing agents may also act as binders, for example, alkylcelluloses and cellulose esters.

In addition, drying oils may be added to assist in drying the aqueous or organic based printing ink on the porous support. Examples of suitable drying oils include linseed oil and China wood oils with or without the addition of modified rosin.

The concentration of the dichlorotriazinyl dye or dyes in the ink will depend on the depth of shade that is required in the final print, decoration or design on the solid molded polymeric article. The concentration of dispersing agent or binder present in the ink relative to the amount of the liquid will depend on the physical properties of the ink required for application to the porous support since the dispersing agent or binder present in the ink affects its viscosity. Preferably, the dichlorotriazinyl dye is added to the printing ink in an amount of about 10 weight percent to about 40 weight percent.

The printing ink containing the dichlorotriazinyl dye or dyes is printed onto a porous support. Examples of the porous support are paper and cloth but, preferably, paper is used. The porous support can be in the form of a complete web or in pieces of any shape.

For large bulk printing, roller printing is the most economical method of producing the paper transfers. For small motifs, badges and so forth, on the solid molded polymeric article, especially if a small number of prints are required, porous supports can be made equally well and more economically by a small flat bedblock or lith printing machine. The ink is printed onto the porous support by any printing technique known to those skilled in the art that produces a printed porous support capable of being transferred to a solid object. Examples of these techniques include: silk-screen, letter-press, offset, lithographic or gravure printing. In addition to applying and drying the printing ink containing the dichlorotriazinyl dye on the porous support, this application can also be performed by impregnating or dyeing the porous support in the printing ink containing the dichlorotriazinyl dye as a solution or dispersion (e.g., in a dye bath).

The porous support can also be printed on both sides, in the process of which dissimilar dyes and/or patterns can be selected for the two sides. The use of a printing machine can be avoided by spraying the printing ink containing dye onto the porous support; for example, by the use of a spray gun. If printing machines are used, examples of such machines for printing the porous supports are described in, for example, U.S. Pat. No. 3,667,258.

The printed porous support is contacted with the solid molded polymeric article to transfer the design or decoration from the support to the article. This contacting is performed in a transfer press at a temperature in the range of about 90° C. to about 250° C. in the presence of steam at atmospheric pressure or a slight superatmospheric pressure up to 200 psi. The steam can be supplied by several methods. The transfer press can be a steam press like those used in laundry steam pressing. Also, the steam can be supplied by placing a cloth that is saturated or nearly saturated with water on top of the printed porous support that is in contact with the solid molded polymeric article and then pressing this assembly in the transfer press at the above recited temperatures. The cloth can be any cloth known to those skilled in the art to retain and hold moisture. An example of such a cloth is cotton broadcloth. Also, a steam jet can be used, for example, by sending it through the part of the press that presses against the solid molded polymeric article to be printed, or it can be sent through the printed porous support in contact with the solid molded polymeric article. It is believed without limiting the scope of the process of the present invention that the steam acts as a carrier of the printing ink containing one or more dichlorotriazinyl dyes. The amount of steam present during transfer is that amount which provides a sufficient humid environment for water droplets to carry the printing ink from the printed porous support to the polymeric article in contact with the porous support.

In the printing process of this invention the solid molded polymeric article upon which a design is to be printed need not be padded before or after printing. But any padding mixture known in the art to be useful in printing on solid molded polymeric articles made with urea formaldehyde resin or melamine formaldehyde resin may be employed.

One particular, and at present, preferred mode of performance of the process according to the invention for use with solid molded polymeric articles made with predominantly urea formaldehyde and with a minor amount of cellulose filler comprises the following stages:

1. A roll of paper is printed by a conventional roller printing press with several different oil based lithographic printing inks differing only in the color of Procion dye contained from the above recited Procion dyes in a preferred amount of 10 to 40 weight percent of the oil based ink.
2. The printed paper support containing the design is placed in contact with the solid, molded button made with urea formaldehyde resin.
3. A damp cloth is placed in contact with the printed paper support and this assembly of button, paper support and damp cloth is placed in a suitable transfer press at a temperature in the preferred range of about 110 to about 170° C. for up to about 2 minutes.
4. After pressing, the button containing the colored design is washed off and dried.

In an alternative embodiment of the process according to this invention, the solid molded polymeric article is a button made with melamine formaldehyde resin, and with a minor amount of cellulose filler. This embodiment is the same as the preferred mode of performance except the melamine formaldehyde resin buttons must be treated to improve the adherence of the ink design to the button. This treatment can be a preheating step before the button is pressed in contact with the paper support, or abrasive surface marring step where the surface of the button is marred to permit better adherence of the ink to the button. The preheating step is performed generally at a temperature in the range of about 100° C. to about 200° C. and preferably at a temperature of around 150° C. for a period of time of around 30 seconds, although any combination of an elevated temperature and time can be used to bring the buttons to a temperature around the temperature of the printing process. The abrasive surface marring step is performed preferably by tumbling the buttons in a barrel with water and an abrasion pumice for around four hours then removing, washing and drying the buttons before printing. Any method for abrasively marring the surface of the button may be used just as long as it scratches the surface layer of the button to expose underlying layers. Also, the button or solid molded polymeric article may be both marred and preheated before being contacted with the printed porous support in the transfer process.

The following examples are illustrative of the present invention, but are not to be construed as limiting the scope thereof in any manner.

EXAMPLE I

A lithographic printing ink is available from Royal Ink Co., New York, N.Y., under the code number OSR-6369 which includes 20 weight percent of Procion MX-5B (reactive red 2). This printing ink containing the dye was printed on paper support in a check pattern by the lithographic printing technique. The lithographic printing was performed on a sheet-fed press available from Harris Seybold Co. (Harris Corp.), Cleveland, Ohio 44113.

The printed paper support containing the design in the color of reactive red 2 was placed in contact with a button made with urea formaldehyde resin and 25 percent by weight of alpha cellulose filler. Then a moist cloth was placed in contact with the printed paper support and this assembly was placed in a transfer press. The transfer press is available from Phipps Faire Co. The assembly was pressed at a temperature of 275° F. (135° C.) for 60 seconds. The assembly was removed from the press and the button washed and dried. The colored design on the button was rub-fast and could not be smeared. The test for rub fastness involved holding the printed button between two pieces of cloth (Dacron cloth and cotton) and rubbing the button with the cloth. Visual inspection was made for color transfer from button to the cloth.

EXAMPLE II

The button printed with a colored design in Example I was boiled in water for 40 minutes. The button was removed and tested for color fastness and rub fastness by visual inspection. The color was only slightly less intense than before boiling and the design and color could not be smeared.

EXAMPLE III

Same procedure as in Example I, but the assembly was pressed in the transfer press at 300° F. (149° C.) for 60 seconds. The decorated, colored button had the same intensity of color as the button in Example I.

EXAMPLE IV

Same procedure as in Example I, but the assembly was pressed in the transfer press at 250° F. (121° C.) for 60 seconds. The decorated, colored button had the same intensity of color as the button in Example I.

EXAMPLE V

A printing ink from Royal Ink Co. with a code number of OSV-6379, which includes 20 weight percent of reactive blue 4 C.I. No. 61205, Procion MX-R blue dye, was placed on the paper support by the same lighographic printing technique used in Example I.

The surface of a button made with melamine formaldehyde resin was marred by tumbling in a barrel with other buttons and with wet pumice for four hours. The buttons then were washed and dried. The marred surface melamine formaldehyde resin button was contacted with the printed paper support. Then a damp cloth was placed in contact with the printed paper support. This assembly was pressed in a transfer press at 275° F. (135° C.) for 60 seconds. The button was removed, washed and dried. The printed button had a rub fast color and design.

EXAMPLE VI (Showing preheating step for melamine formadehyde button)

The same printing ink as in Example V was placed on paper support by the same lithographic printing technique used in Example I.

A button made of melamine formadehyde resin was marred, as in Example V, and was preheated for 30 seconds in a transfer press at 275° F. (135° C.). Then the heated, marred-surfaced melamine formaldehyde resin button was contacted with the printed paper support. This assembly was pressed in a transfer press at 275° F. (135° C.) for 60 seconds. The button was removed, washed and dried. The printed button had greater color intensity and good rub-fast color and design.

EXAMPLE VII

The printed button of Example VI with a color pattern was placed in an oven at 350° F. (177° C.) for 20 minutes. There was no loss or change in color and the design remained intact.

EXAMPLE VIII

The printed button with colored pattern from Example I was sewed on a white cloth and pressed on a commercial laundry steam press for 30 seconds at 300° F. (149° C.). There was no transfer of dye to the cloth or loss of color in the button.

EXAMPLE IX

The lithographic printing ink used in Example I contained 20 weight percent of Procion MX-5B dye (reaction red 2) and Procion MC-8B dye (reactive yellow 86). This printing ink with dyes was printed on a paper support in a check pattern by the lithographic printing technique, as in Example I. The printed porous paper support was placed in contact with buttons made of urea formaldehyde resin on a commercial laundry steam press.

The assembly was pressed for 30 seconds at 300° F. (149° C.). The assembly was removed from the press and the buttons washed and dried.

The two-colored design on the button was clear, distinct, rub-fast and could not be smeared.

The foregoing has described a unique process for printing on solid molded polymeric articles made with urea formaldehyde resin or melamine formaldehyde resin. This process is an advance in printing on polymeric articles because present-day processes have not been able to print on molded articles of urea formaldehyde resin or melamine formaldehyde resin.

According to the provisions of the patent statutes, we have explained the principle, preferred mode of operation of our invention and have illustrated and described what we now consider to represent its best embodiment. However, we desire to have it understood that, within the scope of the appended claims, the invention may be practiced otherwise than as specifically illustrated and described.

We claim:

1. A transfer printing process for printing designs, patterns, decorations, symbols, words and the like on solid molded polymeric articles made of urea formaldehyde resin or melamine formaldehyde resin, comprising:

(a) applying to a porous support a printing ink containing one or more dichlorotriazinyl dyes in an amount of about 10 weight percent to about 40 weight percent to print a design, pattern, decoration, symbol or word on the porous support; and (b) contacting the printed porous support with said solid molded polymeric article made of urea formaldehyde resin or melamine formaldehyde resin in a transfer press at a temperature in the range of about 90° C. to about 250° C. in the presence of steam to transfer the printing ink containing the dye or dyes to said molded article.

2. Process according to claim 1, wherein the porous support is selected from the group consisting of paper, or other cellulose materials in the form of either a screen, cloth, or web.

3. Process according to claim 1, wherein the printing ink containing one or more dichlorotriazinyl dyes is placed on the porous support by a printing technique selected from silk-screen, letterpress, offset, lithographic or gravure printing.

4. Process according to claim 1, wherein the contacting is performed at a pressure of about 5 to about 200 psi.

5. Process according to claim 1, wherein the solid molded polymeric article is made of melamine formaldehyde resin and is preheated at a temperature in the range of about 100° C. to about 200° C. before being contacted with the printed porous support in the transfer press.

6. Process according to claim 1, wherein the solid molded polymeric article contains melamine formaldehyde resin that has a marred surface for better adherence of printing ink.

7. Process according to claim 1, wherein the solid molded polymeric article is made predominantly of urea formaldehyde resin or melamine formaldehyde resin with a minor amount of filler selected from the group consisting of cellulose, wood flour, walnut shell flour, chopped cotton, glass fiber, paper pulps, synthetic fibers and asbestos.

8. Process according to claim 1, wherein the printed molded polymeric article is washed and dried.

9. Process according to claim 1, wherein the residence time of the contacting in the transfer press is in the range of about 0.15 minutes to about 3 minutes.

10. Process according to claim 6, wherein the solid molded polymeric article with a marred surface is preheated at a temperature in the range of about 100° C. to about 200° C. before being contacted with the printed porous support in the transfer process.

11. Process according to claim 1, wherein the printing ink is a water based printing ink.

12. Process according to claim 1, wherein the printing ink is an organic based printing ink.

* * * * *